US005483218A

United States Patent [19]

Roosa

[11] Patent Number: 5,483,218

[45] Date of Patent: Jan. 9, 1996

[54] ELECTRONIC SYSTEM FOR ACTIVATING A MECHANICAL FIRE SIREN

[76] Inventor: Michael J. Roosa, 59 First St., Wurtsboro, N.Y. 12790

[21] Appl. No.: 366,264

[22] Filed: Dec. 29, 1994

Related U.S. Application Data

[63] Continuation in part of Ser. No. 996,664, Dec. 24, 1992, abandoned.

[51] Int. Cl.[6] ..... G08B 29/00

[52] U.S. Cl. ..... 340/309.15

[58] Field of Search ..... 340/281, 290, 340/297, 309.3, 309.4, 309.5, 309.15, 287

[56] References Cited

U.S. PATENT DOCUMENTS 2,396,423 6/1942 Hines ..... 340/287

4,141,007 2/1979 Kavasilies ..... 340/285

4,654,533 11/1985 Bosnak ..... 340/514

*Primary Examiner*—James J. Groody

*Assistant Examiner*—Nathan J. Flynn

[57] ABSTRACT

An electronic device designed to activate a municipal mechanical fire siren upon the receipt of fire from any one of a plurality of inputs, where said fire siren is used to alert fire personnel of an emergency. In addition, through the use of a built in 24 hour clock, the device can operate the siren at noon each day, as a means of automatic testing. The gain time of the siren cycle and the number of cycles per alarm can be preset by the user.

1 Claim, 3 Drawing Sheets

FROM AND GATE 101 (FIG.1)
FROM Q4 OF COUNTER 55 (FIG.2)
FROM AND GATE 103 (FIG.2)
FROM Q5 OF COUNTER 56 (FIG.2)
FROM Q5 OF COUNTER 54 (FIG.2)
TO OR GATE 74 (FIG.1)
Vdd
D C B A
SET
RESET
Q
COM.
0 1 2 3 4 5 6 7 8 9
CK
COUNTER
RESET
59
60
61
74
75
101
103
106
107
108
109
110
111
113
114
115
116
117
118

ELECTRONIC SYSTEM FOR ACTIVATING A MECHANICAL FIRE SIREN

This is a continuation in part of 07/996,664 filed Dec. 24, 1992, now abandoned.

BACKGROUND OF INVENTION

1. Field of Invention

The present invention is an electronic device used to activate a municipal mechanical fire siren upon the receipt of a signal of fire from any one of a plurality of inputs. Its placement would be in a fire station to alert firefighters when they have an alarm by sounding the fire siren.

2. Description of Prior Art

When volunteer fire departments in small towns across the country receive a call for help, the primary method used to call firefighters to the station is by the use of a large fire siren, usually mounted on or in close proximity to the firehouse. It is powerful enough to be heard all through the surrounding area, and the firefighters, upon hearing the siren, are expected to repair with all possible haste to the scene of the fire. If the siren is not activated when an alarm of fire has been reported to the fire station, then the firefighters are not immediately notified of the alarm, and response time is delayed, possibly causing unnecessary loss of life and property.

Most municipal fire sirens today are radio-activated; that is, a central command center receives all telephone calls for help and when one is received, they transmit radio tones of a specific frequency to the fire department needed to respond to the call. At the fire station called, there is a radio receiver that upon receipt of these specific tones, close a dry contact switch for a few seconds. A siren activation system in use at that firehouse can utilize this switch closure to start its process of turning on and turning off the fire siren to produce the wailing effect that is so familiar. After a predetermined length of time, the siren activator shuts down until the next alarm is received. In some cases, a fire department may have their fire siren sound for one cycle at noon each day, as a daily test.

In the past, the method used for turning the siren on and off upon receipt of an alarm was handled by a series of small 120 Volt AC motors. These motors would have cam plates attached to them that would turn with its corresponding motor. A microswitch riding on the edge of the cam would open and close with the contours of the cam. The current to the fire siren was controlled by the opening and closing of this microswitch via several step-up relays, as most siren motors operate around 220–440 Volts in 3-phase form. After a predetermined amount of cycles of the cam, another microswitch would usually shut down the entire system. If the department wanted their siren to cycle once at noon each day as a daily test of the siren, then a separate AC clock/timer had to be purchased to keep track of time. This clock/timer would be preset to trip a microswitch at noon each day and an entirely different series of cams and microswitches would be needed to sound the siren for one cycle at noon and shut down afterward. An example of this older type of mechanical timer is discussed in U.S. Pat. No. 3,728,707 (Herrnreiter).

There are many problems associated with the use of a system of AC motors, cams, and microswitches:

1. The entire system operates at a minimum voltage of 120 volts AC (excluding the siren motor itself). If there was to be an AC power failure, nothing short of an emergency generator would be able to keep the system operational. Without AC power, a reported alarm could go unnoticed by firefighters as the siren would not be operational.

2. By using AC motors, microswitches, cams, and the like, it is observed that there are many moving parts that can be subject to wear and tear, as well as frequent breakdown.

3. Any indicator lights used with the system also use AC voltage. These lamps tend to become very warm after awhile and in some cases, have been known to start a fire, thereby causing a fire in the fire station.

4. The noon clock, also dependent on AC power, will lose track of time during a power failure and may activate the noon test at any time during the day after AC power is restored, until it is manually reset by personnel. There are some timers on the market today that use a spring or a backup battery to keep track of time during a power failure, but their usefulness only spans over a few hours and only function to support the clock- nothing else.

5. If the department wanted to add additional features to their siren activation system (i.e. noon timer, heat detectors to monitor for fire in the station, etc.) they had to seek out additional components and add them to the existing system. This would more often than not result in several different circuit panels, fuse boxes, and additional wiring to be added to an already cluttered system.

6. AC powered components can be susceptible to power surges and interference by lightning and electrical storms. These can quite often lead to false activation of AC powered siren activation systems.

Today, most fire departments in the country have assigned radio receivers or pagers to their personnel. This affords them the opportunity to page firefighters when there is an alarm in addition to activating the siren. The radio page consists of a voice announcement made by a dispatcher actually describing the type of alarm and its location. In most instances, this dispatcher is the person that answers the phone when there is a call for assistance. Approximately 97% of all fire calls to most small fire departments are received from the public via telephone and processed through a dispatcher. The remaining 3% of alarms reported occur usually under one or more of the following methods: 1.) The fire department may employ the use of heat detectors in the building. These are connected to the siren activation system either directly or through a commercially available fire alarm system installed to protect the premises only. If a fire is detected within the building, this would automatically activate the fire siren, thus alerting fire personnel. 2.) A manual pull station (fire call box) is attached to the outside of the building so that passers-by may turn in an alarm to the fire department directly, if necessary. This pull station is also directly connected to the siren activation system. 3.) In some cases, a department may monitor a remote location within its fire protection district for fire. Some examples of remote locations may include a school, church, or government office. Should a fire be detected at any of these locations, a signal can be transmitted to the fire station (usually over a telephone cable or some similar method) to automatically activate the fire siren. In the example of remote location monitoring, there needs to be some sort of fire alarm system in operation at the location to be monitored. There are many examples of fire detection and warning systems in the prior art, specific examples include U.S. Pat. Nos. 4,086,573 (Sasaki); 4,092,642 (Green et al); 4,357,602 (Lemelson); 4,491,830 (Miyabe); 4,550,311 (Galloway et al); 4,673,920 (Ferguson et al). In each of these examples, the systems being described are responsible for monitoring for an outbreak of fire. Upon detecting such a situation, it will then alert occupants of the building, provide emergency assistance in the form of visual and audio alerts, sprinkler activation and the like, and provide means to notify emergency personnel. The siren activation system being discussed in this application would actually receive the signal for assistance from the fire alarm systems described in the prior art. In essence, the siren activation system would provide a second level of notification of fire, but would in actuality be the first level of notification to fire personnel.

If an alarm of fire is reported to the fire department using any of the three methods listed above, the siren is activated without the intervention of a dispatcher. Since the dispatcher (who could technically be located many miles away from the fire station) did not activate the alarm for the department, he is unaware that there is an alarm in progress and therefore does not page firefighters as to the location of the fire. The firefighters upon hearing the siren, would have to "figure out" where the fire is once they reach the station. With the older AC mechanical siren activation systems described earlier, should the siren fail to operate for an automatically activated alarm, then no one would know that there was a fire or similar emergency in progress.

SUMMARY OF INVENTION

The present invention improves on all existing and prior art by addressing the following:

1. All control circuitry responsible for operating the fire siren is in the form of CMOS integrated circuits. This allows for compact design and the ability for system operation at 12 volts DC or less.

2. Since CMOS IC's are being used in the system, current flow is in the milliampere range and the risk of fire caused by overheated components is greatly reduced if not eliminated altogether.

3. Since CMOS ICs now take the place of AC motors and microswitches, it is observed that the liability of using a majority of moving parts in the system has been reduced. This allows for less frequent breakdowns due to the wearing out of contacts, motors, and the like.

4. A sealed, rechargeable battery can be added to the system in order to keep it operational should an AC power failure occur. In the event of such a power failure, the battery would be able to sustain system operation for over 72 hours. If a larger battery is used, then the backup power time will extend even longer.

5. Three normally open contact pairs are included in the system. Shunting any of the pairs together will cause the system to activate. In addition, there are another five pairs of contacts, each activated by applying 18–24 volts DC across each pair. These can be used to activate the system from a remote location. This is useful when monitoring other buildings (such as a school or government office) for fire.

6. Time delay circuitry has been incorporated into the system on each input so that the siren is not immediately activated upon closure of any one of the contact pairs. This delay is used to suppress possible false activations that may be caused by electrical circuit noise or lightning storms.

7. As sirens vary in characteristics from model to model, the gain time (the amount of time it takes a siren to go from silence to its highest wail pitch) will vary as well. For that reason, the present invention has a user adjustable gain time setting that can be varied for the siren being controlled by the system. In addition, the number of cycles (defined as the start of the gain (ON) time of the siren to the start of the next gain time) that the siren will be activated for during an alarm can also be preset by the user. When the system is activated, it turns the siren on and off until the preset number of cycles is reached, at which point the system resets itself and waits for the next alarm condition to occur.

8. A normally open (N.O.) dry contact switch has also been added to the system. This switch is designed to close upon system activation and hold for the duration of the alarm. This switch can be utilized by personnel to automatically activate electrical devices of their choosing upon the receipt of an alarm of fire.

9. A digital clock has been integrated into the system so that if a noon test is desired, the department does not need to purchase an additional timer to add to the system. The noon test feature of the system is designed to sound one siren cycle automatically at 12:00 PM each day, where the gain time of that cycle can be preset by the user.

10. Since the system is battery backed, it no longer is necessary to reset the clock after each power failure. That way, the possibility of a false noon test sounding after a power failure has also been eliminated.

11. The system allows for the interconnection of a commercially available digital dialer unit, similar to those used in the burglar alarm industry for monitoring premises for holdups, or other criminal acts. That same dialer unit can be used with the present invention to alert fire personnel of alarms of fire should the fire siren be rendered inoperable by either an AC power failure or a mechanical defect. This reduces the possibility of fire personnel not being notified at the time of an alarm. The standby battery on the system will also power the dialer unit. This dialer unit would have the capability from the present invention to dial a monitoring service when an alarm is turned into the system and report which input source initiated the alarm. The monitoring service receiving the call from the dialer unit could then contact the dispatcher with the information so that he could page fire personnel and give them the exact location of the fire.

DETAILED DESCRIPTION OF THE INVENTION

There are three primary circuits that make up the present invention. These are given in block diagram form in FIG. 1, 2, and 3.

Figure 1:
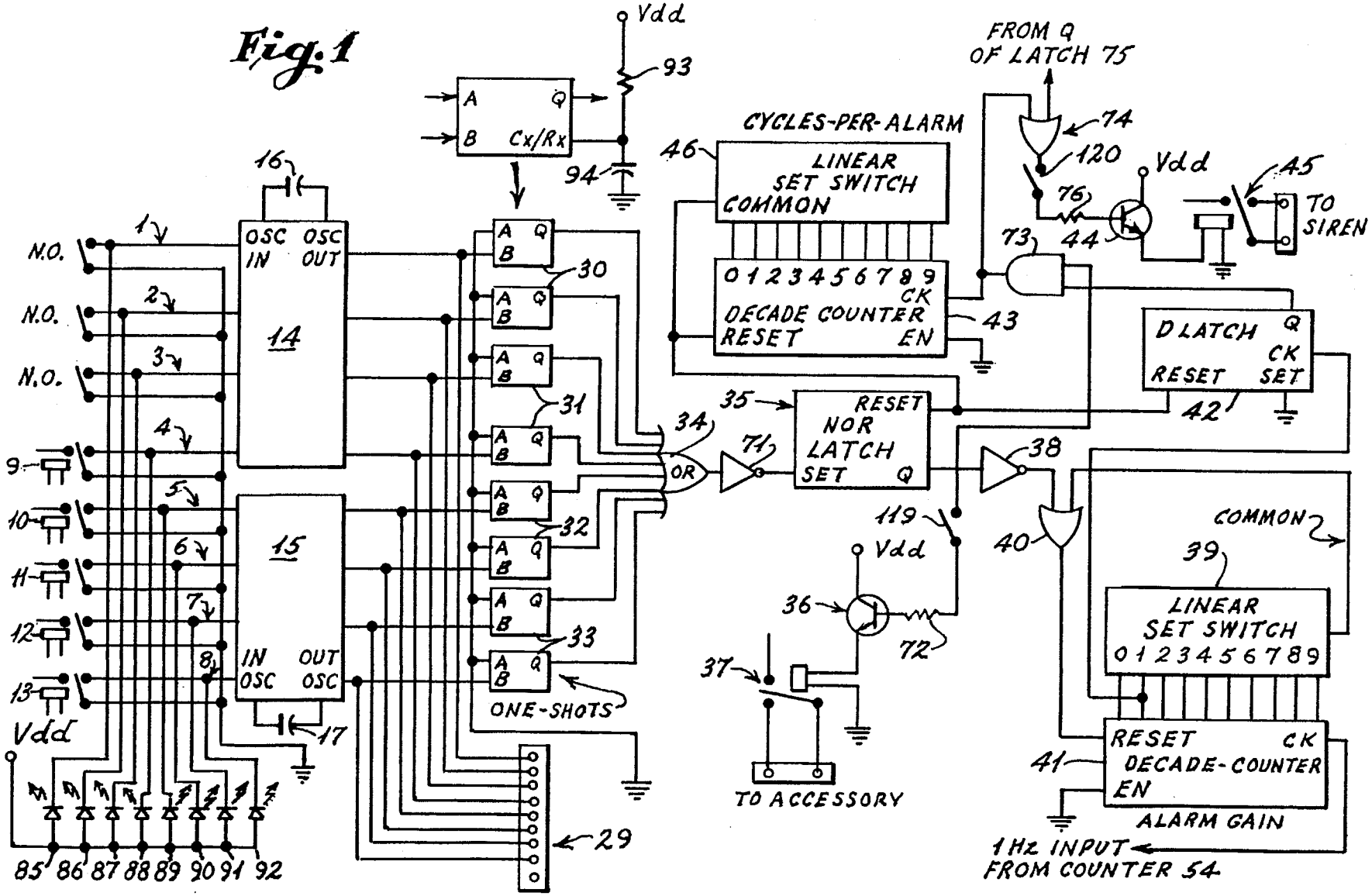
FIG. 1 is a siren activation circuit for use with the present invention.

FIG. 1, "Siren Activation Circuit"

This diagram shows input pairs 1 through 8 to the system that are each able to report the receipt of an alarm condition. These eight pairs are normally open (N.O.) contacts that merely need to be shunted together to activate the system. However, pairs 4 through 8 are closed by microminiature relays 9 through 13 that require a coil voltage potential of 18–24 volts DC to close its corresponding encapsulated switch. This has been done so that inputs 4 though 8 could be tripped by any device that is able to produce an 18–24 VDC external voltage source across the terminals of inputs 4 through 8. LED indicators 85 through 92 are connected between each input pair and Vdd so that when any pair is shunted together, the corresponding LED will illuminate. When an alarm condition is received on any one of input pairs 1 through 8, it passes through one of two MC14490 bounce eliminator IC's 14 and 15, each able to handle four inputs. Capacitors 16 and 17 regulate the delay time of the debouncing IC's. Capacitor 16 is connected to IC 14 between the OSC IN and OSC OUT pins, while capacitor 17 is connected to IC 15 in a similar fashion. In this configuration, IC's 14 and 15 will delay the state of their inputs from changing the state of their outputs for approximately three seconds when a value of 3.3 uF for both capacitors 16 and 17 is used. With IC's 14 and 15 in place as explained, an alarm condition received on any one of input pairs 1 through 8 must hold the selected pair in a shunted condition for a minimum of three seconds in order to allow the output of the appropriate debouncing IC (14 or 15) to go HIGH. The purpose for this delay is to prevent false signals that may appear on inputs 1 through 8 (i.e. those due to electrical noise) from activating the siren. Diodes are used to protect IC's 14 and 15 from damage that may occur at a delay time greater than two seconds. Each IC uses two diodes; one between OSC IN and Vdd and the other between OSC OUT and Vdd. The diodes are connected to allow current flow from the pins of the IC to Vdd only. Indicator LEDs 22 through 29 are connected at each input to the system before IC's 14 and 15 in order to display the status of each input pair 1 through 8 to the user. After debouncing, all eight outputs of IC 14 and 15 are fed into the 'B' inputs of one-shot IC's 30 through 33 whose 'A' inputs are all connected to ground. The 'B' input of each one-shot circuit is also connected HIGH via 1 KΩ resistors in order to hold the 'B' input level HIGH when the circuit is idle. The active-low RESET input of each one-shot is connected HIGH to disable the reset function. Each one-shot IC (30 through 33) contains two individual one shot circuits. The purpose of the one-shot circuit for each output of IC's 14 and 15 is to guarantee that should any input pair 1 through 8 become seized (i.e. did not reset after previously initiating an alarm condition), it will not prohibit the system from detecting an alarm condition on any of the remaining inputs. The one-shot circuits of IC's 30 through 33 are designed to have short output pulse lengths so the Q of each circuit will not be able to remain at a HIGH level for an extended period of time. This is done by connecting a 100 KΩ resistor 93 and a 0.01 uF capacitor 94 to the timing input of each one-shot. The other side of resistor 93 is connected HIGH, while the other side of capacitor 94 is grounded. All eight outputs of one-shots 30 through 33 are connected in parallel to plug 29 that allows for the interconnection of a commercially available digital dialer unit, if desired by the user.

Figure 2:
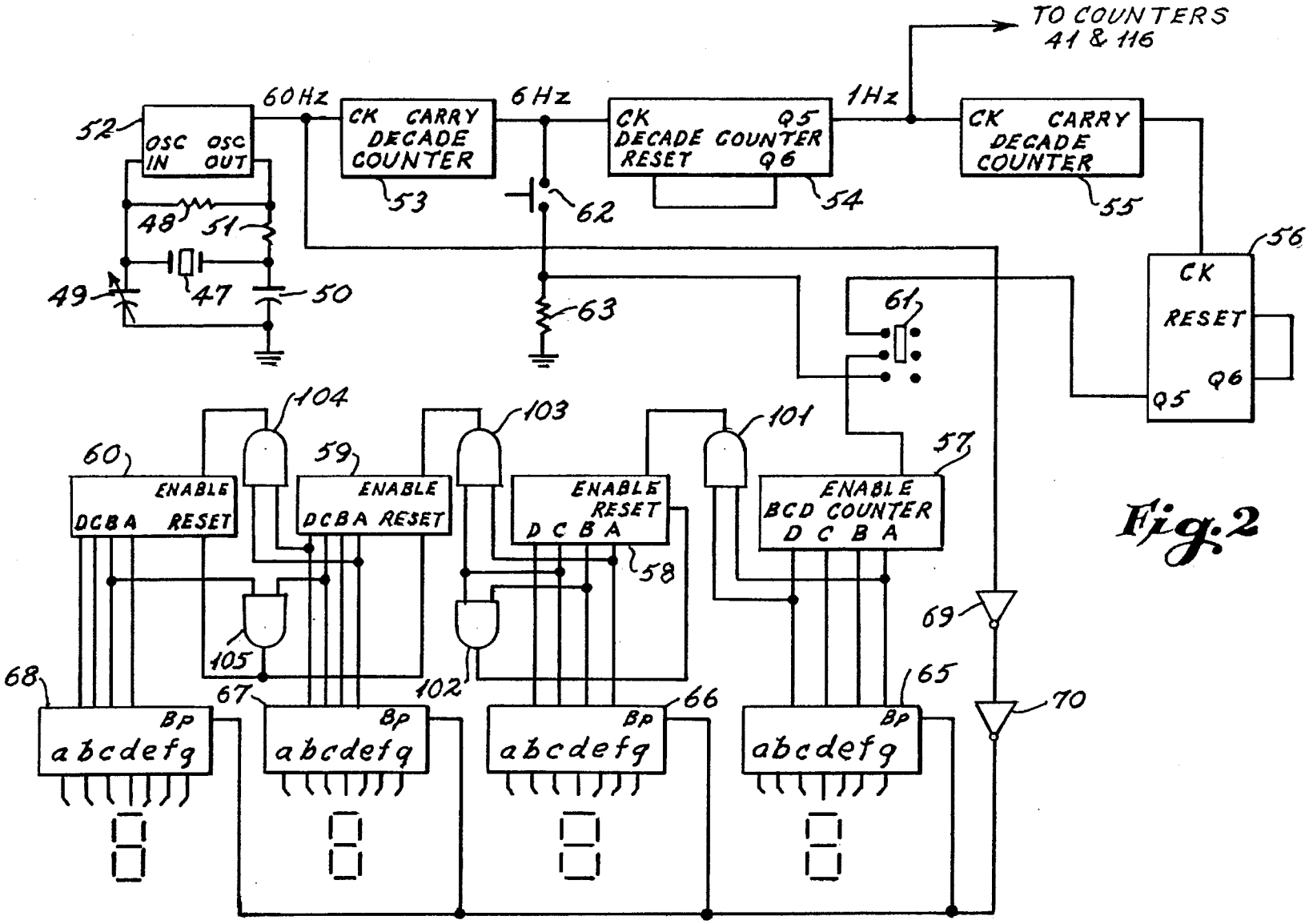
FIG. 2 is a clock circuit for use with the present invention.

The eight separate outputs from one-shots 30 through 33 are next fed into an 8-input OR gate 34 so that only one output is needed to activate the rest of the system. The output of OR gate 34 is then inverted by inverter 71 and directed into the SET input of NOR latch 35. A HIGH output from OR gate 34 will drive the NOR latch 35 output LOW where it will remain until it is reset. The Q output of NOR latch 35 output is then directed to two different functions: 1. it is used to drive the base of NPN transistor 36 via a 2.2 KΩ, ¼W resistor 72. The collector of transistor 36 is connected HIGH and the emitter is connected to the coil of relay 37 whose encapsulated switch is used as a normally open accessory switch. A switch 119 is used in between the Q output of NOR latch 35 and resistor 72 so that when open, will prohibit the system from closing the accessory switch during an alarm condition; 2. The Q output of NOR latch 35 output is then inverted by inverter gate 38. The common point of linear set switch 39, which allows the user to direct one of ten circuits to a common point, is then input to OR gate 40 along with the output from inverter gate 38. The resulting output from OR gate 40 is then used as the RESET input for CMOS decade counter 41. Positions 1 through 10 of set switch 39 are connected to outputs 0 through 9 of counter 41 respectively. The ENABLE input to counter 41 is grounded, and the CLOCK input is fed by a 1 Hz square wave being generated by counter 54 in the clock circuit (FIG. 2). In this scenario, the gain time of the siren, in seconds, can be directly set by the user by selecting the desired setting on set switch 39. When the Q output of NOR latch 35 is HIGH, the output of inverter gate 38 goes LOW. Provided that the common point of set switch 39 is also LOW, the output of OR gate 40 will provide a LOW on the RESET for counter 41. This will cause counter 41 to begin incrementing. When the Q1 output of counter 41 is HIGH, it will provide a CLOCK pulse to D-latch 42, whose SET input is grounded and D input is connected to its own NOT-Q output. When D-latch 42 receives a HIGH on its clock input from counter 41, it allows its Q output to go HIGH. This output is then directed to the input of AND gate 73 along with the Q output from latch 35. The output of AND gate 73 is used as the clock input for the cycles-per-alarm decade counter 43, whose ENABLE input is grounded. The output of AND gate 73 is also connected to the input of OR gate 74 along with the Q output from D-latch 75. The output from OR gate 74 is used to drive the base of NPN transistor 44 via a 2.2 KΩ, ¼W resistor 76. The collector of transistor 44 is connected HIGH and emitter the is connected to the coil of relay 45 whose encapsulated switch is used to start the siren. A switch 120 is used between the output of OR gate 74 and resistor 76 so that when open, will prohibit the system from activating the fire siren during an alarm condition. When a HIGH pulse is received on the clock input to counter 43, it increments one step. A second set switch 46, being the same type as set switch 39, has its positions 1 through 10 connected to output stages 0 through 9 of counter 43, respectively. The common point of set switch 46 is connected to the RESET inputs of counter 43, D-latch 42, and NOR latch 35.

When the user-preset value of counter 41 is reached, a HIGH output from set switch 39 will be input to OR gate 40. This will result in a HIGH output which will reset counter 41 back to zero. This will cause the common point of set switch 39 to go LOW and thereby cause the RESET of counter 41 to also go LOW, and begin counting again. When the first count stage is reached, a HIGH pulse will be sent once again to the CLOCK input of D-latch 42. This time, since the Q of the D-latch 42 is already HIGH, this next input pulse will drive Q LOW, thus shutting off the siren. When the user-preset value of counter 41 is reached, a HIGH output from set switch 39 will be input to OR gate 40. This will result in a HIGH output which will reset counter 41 back to zero. This will cause the common point of set switch 39 to go LOW and thereby cause the RESET of counter 41 to also go LOW, and begin counting again. When the first count stage is reached, a HIGH pulse will be sent once again to the CLOCK input of D-latch 42. When a HIGH appears on the counting stage output of counter 43 that is currently connected to the common point of set switch 46, via user input, it will reset counter 43, D-latch 42, and NOR latch 35. When NOR latch 35 is reset, it's Q will go LOW, which in turn will turn off transistor 36 and cause the output of inverter gate 38 to go HIGH. The will result in a HIGH input to OR gate 40, which will respond by applying a HIGH to the RESET input of counter 41. This will disable all ability for the circuit to count until the next time a HIGH input is received by NOR latch 35 via OR gate 34. If a HIGH did not yet appear on the common point of set switch 46, then the entire counting process of counter 41 would have started again. It should now be realized that every other counting cycle of counter 41 will increment counter 43 and turn on the siren. This is how the wailing effect of the siren is produced.

FIG. 2, "Clock Circuit"

At the heart of the clock circuit is a 3.5759 MHz quartz crystal oscillator 47, which is made to oscillate by connecting variable capacitor 49 with a range of 5–36 pF between one lead of oscillator 47 and ground and connecting a 33 pF fixed value capacitor 50 between the other lead of oscillator 47 and ground. One lead of oscillator 47 is connected to the OSC IN pin of a MM5369 frequency divider IC 52. The other lead of oscillator 47 is connected to a 2.2 K Ω resistor 51. The other lead of resistor 51 is connected to the OSC OUT pin of IC 52. A 20 M Ω resistor 48 is connected across the OSC IN and OSC OUT pins of IC 52. Connected in this fashion, when power is applied, the resulting output of IC 52 is a 60 Hz square wave. This square wave is then applied to the CLOCK input of a CMOS decade counter 53 whose ENABLE and RESET inputs are both grounded, thus allowing it to count whenever a clock signal is applied on its CLOCK input. In this configuration, the CARRY output of counter 53 will go HIGH once for every ten clock pulses on the input from IC 52. This resulting output is then considered one-tenth the value of the input, or 6 Hz. This 6 Hz output is then connected to; 1) one side of a normally open push button switch 62 and; 2.) the CLOCK input of another decade counter 54, whose ENABLE is grounded, and RESET is connected its own Q6 output. In this configuration, the Q5 output of counter 54 will go HIGH once for every six clock pulses on the input from counter 53. This resulting output is one-sixth the value of the input (one pulse every second), or 1 Hz. This 1 Hz output is sent to different parts of the circuit as follows:

1. It is applied to the CLOCK input of a CMOS decade counter 55, whose ENABLE and RESET inputs are both grounded, thus allowing it to count whenever a clock signal is applied on its CLOCK input. In this configuration, the CARRY output of counter 55 will go HIGH once for every ten clock pulses on the input from counter 54. This resulting output is then considered one-tenth the value of the input, or 1 pulse every 10 seconds. The output of counter 55 is then connected to the CLOCK input of another decade counter 56, whose ENABLE is grounded, and RESET is connected to its own Q6 output. In this configuration, the Q5 output of counter 56 will go HIGH once for every six clock pulses on the input from counter 55. This resulting output is one-sixth the value of the input, or 1 pulse per minute. The output of counter 56 is connected to the 'A1' terminal of a double-pole, double-throw switch 61, whose common terminal 'C1' is connected to the ENABLE input of a BCD counter 57 which indicates minutes. The CLOCK and RESET inputs of counter 57 are both grounded. When switch 61 is in the A-C shunt position, it allows counter 57 to count in BCD form whenever a HIGH level is present on its ENABLE input. The 'A' and 'D' outputs of counter 57 are ANDed together by AND gate 101, the output of which is connected to the ENABLE input of another BCD counter 58, which indicates tens of minutes. The CLOCK input of counter 58 is grounded. The 'B' and 'C' outputs of counter 58 are ANDed together by AND gate 102, the output of which is connected to the RESET input of counter 58. The 'A' and 'C' outputs of counter 58 are ANDed together by AND gate 103, the output of which is connected to the ENABLE input of BCD counter 59, which indicates hours. The CLOCK input of counter 59 is grounded. The 'A' and 'D' outputs of counter 59 are ANDed together by AND gate 104, the output of which is connected to the ENABLE input of BCD counter 60, which indicates tens of hours. The CLOCK input of counter 60 is grounded. The 'B' output of counter 60 and the 'C' output of counter 59 are ANDed together by AND gate 105, the output of which is connected to the RESET inputs of counters 59 and 60. In this fashion, a 24-hour clock has been constructed that will keep time from 00:00:00 to 23:59:59 before resetting back to midnight, or 00:00:00.

2. It is also applied to the CLOCK inputs of counters 41 (Siren Activation Circuit), and 116 (Noon Test Circuit).

Push button switch 62, which has one pole connected to the output of counter 53 as explained previously, has its other pole connected in parallel to a 1 KΩ, ¼W resistor 63 which has its other side grounded, and terminal 'B1' of switch 61. To set the clock, switch 61 should be first placed in the B-C shunt position. This action will disable the ability for counters 57, 58, 59, and 60 to advance. Resistor 63 prevents the circuit to drift as the B-C shunt position of switch 61 would theoretically leave an open circuit. In this configuration, depressing and holding switch 62 will allow the output of counter 53 to be directly applied to the input of counter 57. This will allow the user to rapidly advance the time stored in counters 57 through 60. To return to the normal time keeping mode, switch 61 should be placed back into the A-C shunt position.

To display the time of day to the user, BCD-to-seven segment decoder/driver IC's are used to convert the output of counters 57 to 60 to seven segment numerals that are displayed on LCD 64. Only the minutes, tens of minutes, hours, and tens of hours are displayed to the user. Therefore, only four BCD-to-seven segment decoder/driver IC's are needed. Driver 65 is connected to counter 57 as follows: The A output of counter 57 is connected to the A input of driver 65. The B output of counter 57 is connected to the B input of driver 65. The C output of counter 57 is connected to the C input of driver 65. The D output of counter 57 is connected to the D input of driver 65. The outputs of driver 65 make up the segments a through g of the seven-segment digit of the LCD display that corresponds to the minutes of the clock (the extreme right-hand side digit of the LCD display). Driver 66 is connected to counter 58 in the exact same manner as driver 65 is connected to counter 57. The outputs of driver 66 make up the segments a through g of the seven-segment digit of the LCD display that corresponds to the tens of minutes of the clock (the second from the extreme right-hand side digit of the LCD display). Driver 67 is connected to counter 59 in the exact same manner as driver 65 is connected to counter 57. The outputs of driver 67 make up the segments a through g of the seven-segment digit of the LCD display that corresponds to the hours of the clock (the second from the extreme left-hand side digit of the LCD display). Driver 68 is connected to counter 60 in the exact same manner as driver 65 is connected to counter 57. The outputs of driver 68 make up the segments a through g of the seven-segment digit of the LCD display that corresponds to the tens of hours of the clock (the extreme left-hand side digit of the LCD display). In order to allow the LCD numerals to appear on the display 64, the backplane input of drivers 65 through 68 are each connected to the 60 Hz output of IC 52 via two inverting buffers 69 and 70. The purpose of inverters 69 and 70 is to allow connection of LCD drivers 65 through 68 without overloading the output of IC 52.

Figure 3:
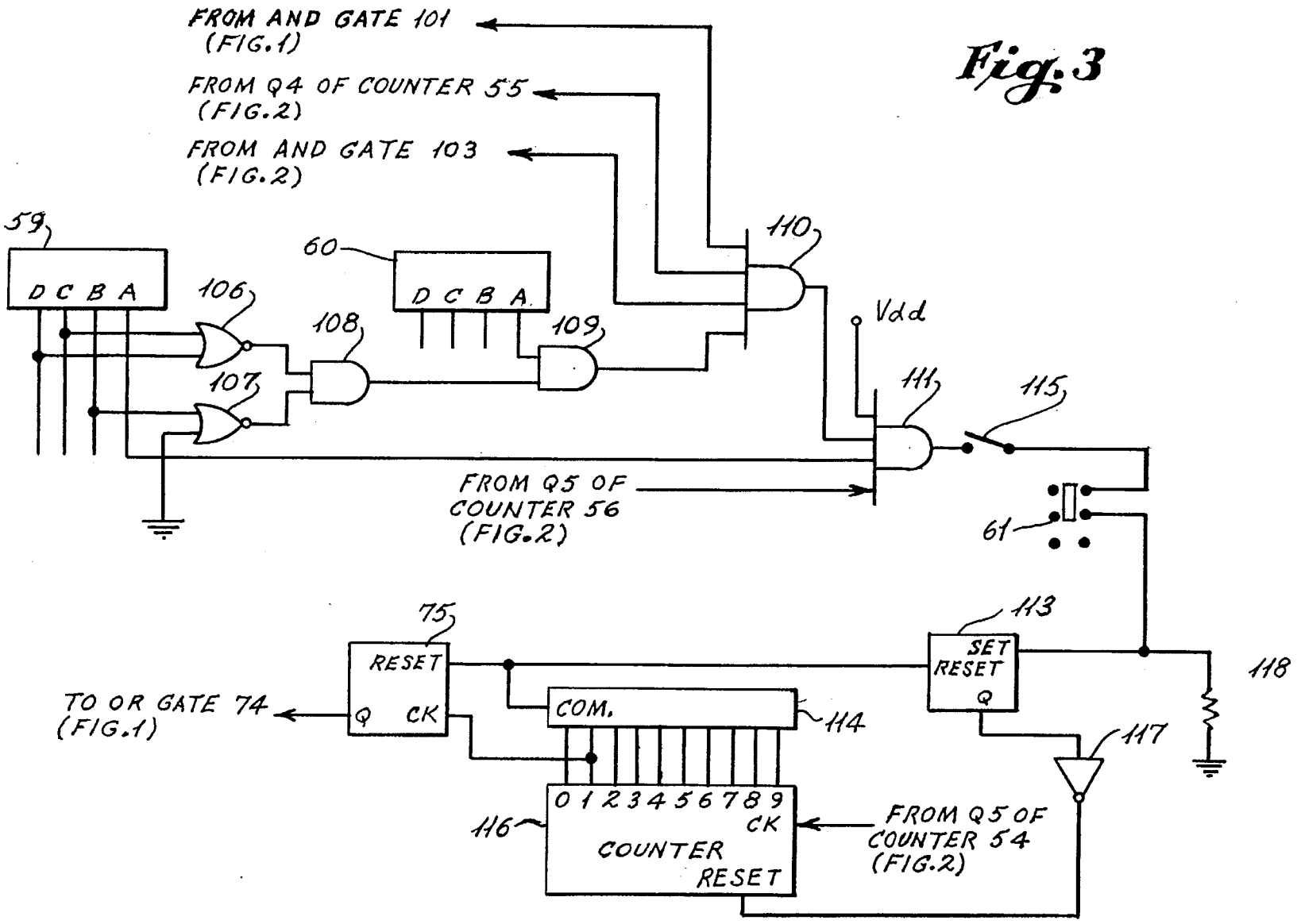
FIG. 3 is a noon test circuit for use with the present invention.

FIG. 3, "Noon Test Circuit"

The Noon Test Circuit, which is responsible for controlling the activation of a single siren cycle each day at 12:00 PM, is actually a cross between the two circuits already discussed in FIGS. 1 & 2. Specific outputs from the clock circuit are combined in such a manner that when 11:59:59 is present on the clock, a HIGH signal lasting a period of one second will be generated. This is accomplished as follows:

1.) the 'C' and the 'D' output of counter 59 are NORed together by NOR gate 106; 2.) the 'B' output of counter 59 and ground are NORed together by NOR gate 107; 3.) the outputs of NOR gates 106 and 107 are ANDed together by AND gate 108; 4.) the 'A' output of counter 60 and the output of AND gate 108 are ANDed together by AND gate 109; 5.) the output of AND gate 101, the Q9 output of counter 55, the output of AND gate 103, and the output of AND gate 109 are all ANDed together by a four-input AND gate 110; 6.) the output of AND gate 110, the 'A' output of counter 59, the Q5 output of counter 56, and Vdd (constant HIGH input), are all ANDed together by four-input AND gate 111. The output of AND gate 111 is sent to the 'A2' terminal of switch 61, whose common terminal 'C2' is connected to the SET input of NOR latch 113, whose ENABLE input is connected HIGH (to Vdd). The common point of linear set switch 114, which allows the user to direct one of ten circuits to a common point, is input to the RESET inputs of NOR latch 113 and D-latch 75, whose SET input is grounded and D input is connected to its own NOT Q output. Positions 1 through 10 of switch 114 are connected to outputs 0 through 9 of CMOS decade counter 116 respectively. The ENABLE input of counter 116 is grounded, while the CLOCK input is fed by the output of counter 54. The Q1 output of counter 116 is also connected to the CLOCK input of D-latch 75. The Q output of NOR latch 113 is inverted by inverter gate 117, the output of which is fed to the RESET input of counter 116.

When 11:59:59 appears on the BCD outputs of the clock circuit, it will cause the output of AND gate 111 to go HIGH. With switch 61 is in the A-C shunt position, the HIGH output of AND gate 111 will cause NOR latch 113 to set. The resulting HIGH appearing on the Q output of latch 113 will cause the output of inverter gate 117 to go LOW. This will allow counter 116 to begin incrementing. When the Q1 output of counter 116 is HIGH, it will provide a clock pulse to D-latch 75. This will cause the Q output of D-latch 75 to go HIGH. This output is then ORed together with the output of AND gate 73 by OR gate 74, whose output indirectly will cause the siren to sound, as discussed in FIG. 2, Part 1. When the user-preset value of counter 116 is reached, a HIGH output from the common point of switch 114 will be sent to the RESET inputs of D-latch 75 and NOR latch 113, thus shutting down the siren after one cycle. It should be seen that the purpose of switch 114 is to set the gain time of the noon test siren, similar to the method used for the gain time of the siren during an alarm condition. A switch 115 is placed in series between the output of AND gate 111 and switch 61, so that if opened, it will prohibit the system from sounding the siren for a noon test. The main purpose of switch 61 is to allow the user to set the time of the system clock. The second pole has been added to this same switch to prevent an accidental false noon test from occurring should the user, during the course of setting the clock, happen to advance the time to 11:59 at the precise time that the Q9 output of counter 55 and the Q5 output of counter 56 are both HIGH. A 1 K Ω resistor 118 has been connected between the SET input of NOR latch 113 and ground to prevent an accidental noon test activation while moving either switch 61 or switch 115 to another position.

What I claim is:

1. A device for activating and cycling a mechanical fire siren, said device comprising:

a plurality of input means for producing first signals when a predetermined event occurs, wherein each input means is connected between two terminals of an energy source which is either derived by said device or by an external power source;

a delay means, connected to said plurality of input means, for delaying said first signals for a predetermined period of time and producing a delayed version of said first signal;

an activation circuit means, connected to said delay means to receive said delayed version of said first signal, for producing an output pulse whenever any one of said input means produces said first signal, said activation circuit means ignores the length of time that any one of said input means produces said first signal so that should any of said plurality of input means become disabled or seized, the activation circuit means will still produce said output pulse should another first signal be detected form any one of the other input means;

a latching means, connected to activation circuit means, for latch and holding said output pulse until a reset signal is received;

a cycles per alarm means for controlling the number of siren cycles pre alarm, where the number of cycles per alarm is adjustable;

a siren gain circuit means for controlling the gain time of the siren according to a gain time clock signal;

a 24 hour clock circuit having a seven segment display for displaying hours and minutes, wherein said 24 hour clock provides the gain time clock signal to said siren gain circuit means;

a test circuit means, connected to said 24 hour clock, for proving a test signal at a predetermine time each day;

a relay attached to said siren for controlling the supply of power to the siren;

a control means, connected to said relay, said test circuit means, said activation circuit means, said siren gain circuit means, said cycle per alarm means and said latching means, for energizing said relay thereby causing the mechanical fire siren to sound when the output pulse is received from said latching means and for sending a reset signal to said latching means after the mechanical fire siren has completed a predetermined number of cycles, and for energizing said relay when said test signal is received from said test circuit means thereby causing said mechanical fire siren to be triggered for one cycle.

* * * * *